United States Patent [19]

Zyglewyz

[11] 4,235,295

[45] Nov. 25, 1980

[54] EARTH BORING BIT WITH RENEWABLE BEARING SURFACE

[75] Inventor: Steve W. Zyglewyz, De Soto, Tex.

[73] Assignee: Dresser Industries, Inc., Dallas, Tex.

[21] Appl. No.: 17,677

[22] Filed: Mar. 5, 1979

[51] Int. Cl.[3] ..... E21B 10/22

[52] U.S. Cl. ..... 175/371; 308/8.2; 175/372

[58] Field of Search ..... 175/371, 372; 308/8.2, 308/237 R, 201

[56] References Cited

U.S. PATENT DOCUMENTS

| | | | |
|---|---|---|---|
| 3,612,197 | 10/1971 | Motoyama | 175/372 |
| 3,720,274 | 3/1973 | McCallum | 175/372 |
| 3,721,307 | 3/1973 | Mayo | 175/372 |
| 3,966,274 | 6/1976 | Penny | 308/8.2 |

FOREIGN PATENT DOCUMENTS

| | | | |
|---|---|---|---|
| 463773 | 12/1975 | U.S.S.R. | 175/372 |

*Primary Examiner*—James A. Leppink
*Assistant Examiner*—Richard E. Favreau
*Attorney, Agent, or Firm*—Fred A. Winans; Eddie E. Scott

[57] ABSTRACT

A rolling cone cutter earth boring bit is provided with a load carrying bearing surface that can be renewed during the earth boring operation. A canister bearing element is positioned between the bearing pin and the rolling cone cutter. The rolling cone cutter rotates about the canister bearing element in a first direction during normal drilling operations. The canister bearing element has directional stops on its inside surface. These directional stops engage directional stops on the bearing pin and prevent rotation of the canister bearing element during normal drilling operations. The bearing surface can be renewed by reversing the direction of cutter rotation thereby disengaging the canister bearing element from the directional stops and allowing it to rotate in the opposite direction until a new bearing surface is in the load area. The new surface is locked in place by the directional stops or independent means and the rolling cone cutter again is rotated in the first direction for normal drilling operation.

7 Claims, 8 Drawing Figures

FIG. 1
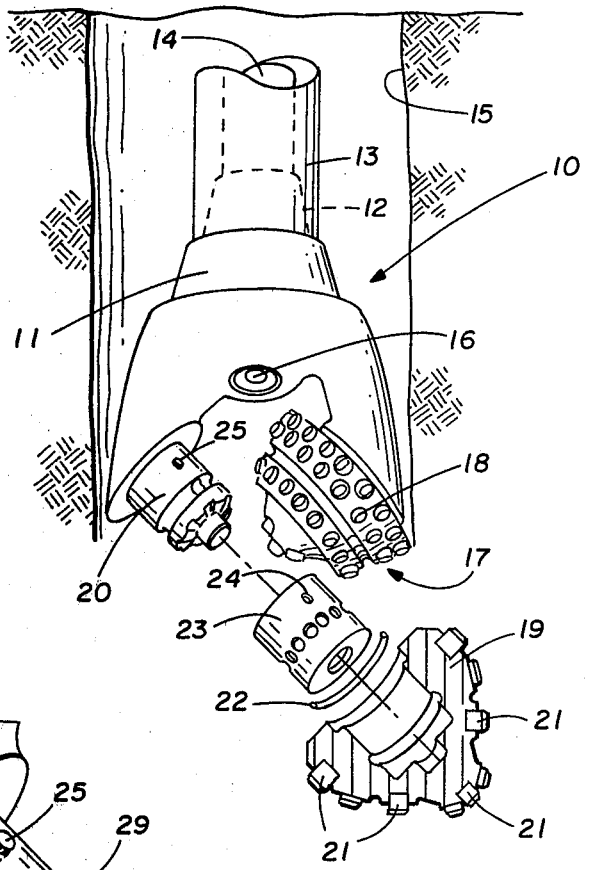
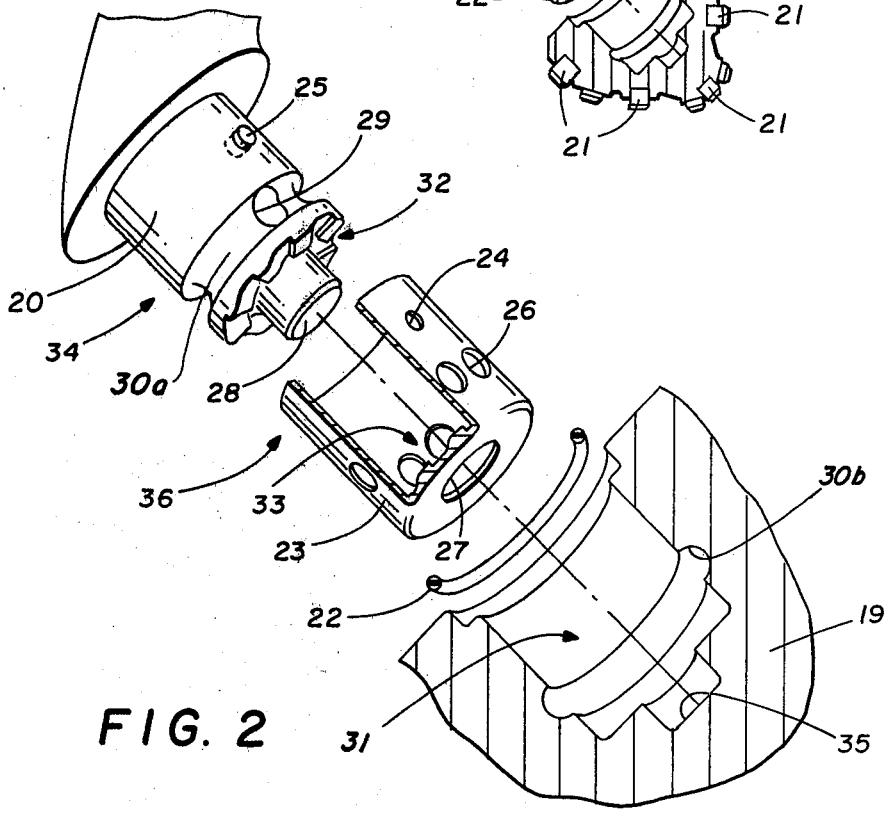
FIG. 2

EARTH BORING BIT WITH RENEWABLE BEARING SURFACE

BACKGROUND OF THE INVENTION

The present invention relates to the art of earth boring and, more particularly, to a rolling cone cutter earth boring bit. Earth boring bits of this type are adapted to be connected as a lower member of a rotary drill string. As the drill string is rotated, the bit disintegrates the formations to form an earth borehole. Generally, the bit includes a multiplicity of individual arms that extend angularly downward from the main body of the bit. The lower end of each arm is shaped to form a spindle or bearing pin. A rolling cone cutter is mounted upon each bearing pin and adapted to rotate thereon. Individual bearing systems promote rotation of the rolling cone cutter. These bearing systems have traditionally been roller bearings, ball bearings, friction bearings or a combination of the aforementioned bearings. The rolling cone cutters include cutting structure on their outer surfaces that serve to disintegrate the formations as the bit is rotated.

In addition to rotational forces, the bit is subjected to a thrust load during the earth boring operation. The weight of the drill string and/or the downward force applied by the rotary drilling equipment apply a substantial thrust load upon the earth boring bit. Since the thrust load is applied axially to the bit, a specific load area is produced on the lower side of each bearing pin. As the bit is rotated and moved through the earth formations, the load area tends to wear. This wear can result in erratic movement of the rolling cone cutter upon the bearing pin. Such erratic movement can cause difficulties with the sealing system of the bit. Further, the wear in the load area tends to deteriorate the bearing surface and reduces the lifetime of the bit.

DESCRIPTION OF PRIOR ART

A general summary of typical bearing systems used in prior art earth boring bits is set forth in U.S. Pat. No. 3,235,316 to J. R. Whanger patented Feb. 15, 1966. in U.S. Pat. No. 3,720,274 to Hugh F. McCallum patented Mar. 13, 1973, an earth boring bit thrust bearing is shown. In this patent intermediate thrust elements are shown positioned between the rolling cutters and the bearing pins of the bit. Each intermediate thrust element is located between a thrust surface on the bearing pin and a thrust surface on the associated cutter.

SUMMARY OF THE INVENTION

The present invention provides an earth boring bit with a bearing system having a renewable load bearing surface. At least one bearing pin extends from the body of the bit and a rolling cone cutter is rotatably mounted upon the bearing pin. The bearing system includes a bearing element positioned between the bearing pin and the rolling cone cutter. The bearing element includes directional stop means. The directional stop means engages directional stop means on either the bearing pin or the rolling cone cutter and prevents relative rotation of the bearing element with respect to the bearing pin or rolling cone cutter during normal drilling operations. Reversing the direction of rotation of the rolling cone cutter disengages the bearing element from the bearing pin or rolling cone cutter and allows it to rotate in the opposite direction until a new bearing surface is located in the load area. The new bearing surface is locked in place in the load area and normal drilling operations are continued. The foregoing and other features and advantages of the present invention will become apparent from a consideration of the following detailed description of the invention when taken in conjunction with the accompanying drawings.

BRIEF DESCRIPTION OF THE DRAWINGS

FIG. 1 is an illustration of an earth boring bit constructed in accordance with the present invention.

FIG. 2 is an enlarged view of the bearing area of the bit illustrated in FIG. 1.

DETAILED DESCRIPTION OF THE INVENTION

Figure 3:
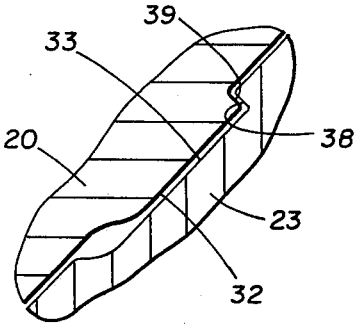
FIGS. 3, 4 and 5 illustrate the directional stop elements of the bit shown in FIGS. 1 and 2.

Referring now to FIG. 1 of the drawings, a rolling cone cutter rotary rock bit 10 constructed in accordance with one embodiment of the present invention is illustrated. The body 11 of the bit 10 includes an upper threaded portion 12 that allows the bit 10 to be connected to the lower end of a rotary drill string 13. The bit 10 and drill string 13 also include a central passageway 14 extending along their central axes. Drilling fluid enters the bit 10 from the drill string section immediately above and passes downward through jet nozzles 16 to the bottom of the well bore 15 to flush cuttings and drilling debris from the well bore 15. The drilling fluid carries the cuttings and drilling debris upward in the annulus between the wall of the borehole 15 and the outside of the bit 10 and drill string 13 to the surface.

Individual bearing pins extend from the body 11 of the bit 10. A first cutter 17 is rotatably positioned on the journal portion or bearing pin of a first arm and adapted to disintegrate the earth formations as the bit 10 is rotated. The cutting structure 18 on the surface of cutter 17 contacts and disintegrates the formations in a manner that is well known in the art. A second cutter 19 is rotatably positioned on the journal portion or bearing pin 20 of a second arm and adapted to disintegrate the earth formations as the bit 10 is rotated. The cutting structure 21 on the surface of cutter 19 contacts and disintegrates the formations in a manner that is well known in the art. The cutting structure 21 is shown in the form of tungsten carbide inserts. However, it is to be understood that other cutting structures such as steel teeth may be used as the cutting structure on the rolling cone cutter 19 and rolling cutter 17.

Bearing systems are located in the bearing area between the cutter 19 and the bearing pin 20. An O-ring seal 22 is positioned between the cutter 19 and the bearing pin 20. This seal 22 retains lubricant in the bearing area around the bearing systems and prevents any materials in the well bore 15 from entering the bearing area. A canister outer bushing 23 is positioned between bearing pin 20 and rolling cutter 19. Bushing 23 has directional stops on its inside surface. These directional stops engage directional stops on the bearing pin 20, thus preventing rotation of the canister outer bushing 23 during rotation of the cone cutter 19 under normal drilling operations. The canister outer bushing 23 provides the wear surface in the load area. Reversing cone cutter 19 rotation disengages the canister outer bushing 23, rotating it in the opposite direction until the spring pin hole 24 of the canister outer bushing 23 and spring pin 25 of the journal engage and stop the canister outer bushing at a new location.

Referring now to FIG. 2, an enlarged view of the bearing area of the bit 10 is shown. The cutter 19 is rotatably positioned on the bearing pin 20 and adapted to disintegrate the earth formations as the bit 10 is rotated. The bearing pin 20 projects from the cutter receiving surface of the depending arm. A series of ball bearings bridge between raceways 30a and 30b to insure that rotatable cutter 19 is rotatably locked on bearing pin 20. The rotatable cutter 19 is positioned upon bearing pin 20 and the series of ball bearings are inserted through a bore 29 extending into bearing pin 20. The ball bearings extend through the holes 26 in the canister outer bushing 23. After the ball bearings are in place, a plug is inserted in the bore and welded therein.

A number of bearing systems are located between the bearing pin 20 and cutter 19 to promote rotation of cutter 19. A thrust button 35 is located in the nose of cutter 19. The nose 28 of the bearing pin 20 contacts the thrust button 35 through hole 27 in bushing 23. The canister outer bushing 23 is positioned between the bearing pin 20 and rolling cutter 19. The bushing 23 has directional stops 33 on its inside surface. These stops 33 engage with machined directional stops 32 on the bearing pin 20, thus preventing rotation of the canister outer bushing 23 during cone cutter 19 rotation under normal drilling operations. The canister outer bushing 23 acts as the bearing pin wear surface.

In addition to rotational forces, the bit 10 is subjected to a thrust load during the earth boring operation. The weight of the drill string and/or the downward force applied by the rotary drilling equipment apply a substantial thrust load upon the earth boring bit 10. Since the thrust load is applied axially to the bit, a specific load bearing area 34 is produced on the lower side of the bearing pin 20. The canister outer bushing 23 being locked to the bearing pin 20 also has a specific load area 36 on its lower side. The outer bearing surface 31 of the rolling cone cutter 19 rotates against the load area 36 on the outer canister bushing 23. As the bit 10 is rotated and moved through the earth formations, the load bearing area 36 tends to wear. This wear can result in erratic movement of the rolling cone cutter 19 upon the bearing pin 20. Such erratic movement can cause difficulties with the sealing system of the bit. Further, the wear of the load bearing area tends to deteriorate the bearing surface and reduces the lifetime of the bit.

Figure 4:
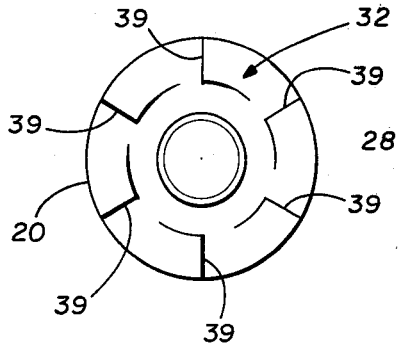
Figure 5:
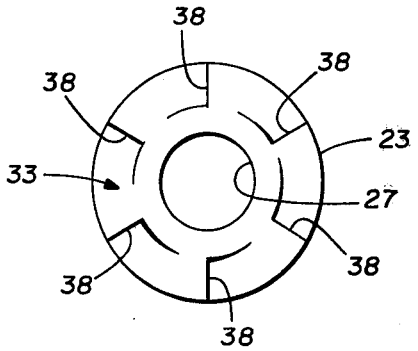

Referring now to FIGS. 3, 4 and 5, the directional stops 32 and 33 will be explained in greater detail. The bushing 23 has directional stops 33 on its inside surface. These directional stops 33 engage directional stops 32 on the bearing pin 20, thus preventing rotation of the canister outer bushing 23 during rotation of the cone cutter 19 under normal drilling operations. The shoulder 39 on directional stop 32 engages the shoulder 38 on directional stop 33. This locks the bushing 23 to the bearing pin during normal drilling operations. Reversing cone cutter 19 rotation disengages the canister outer bushing 23, rotating it in the opposite direction until the spring pin hole 24 (FIG. 2) of the canister outer bushing 23 and spring pin 25 of the bearing pin 20 engage and stop the canister outer bushing 23 at a new location.

Figure 6:
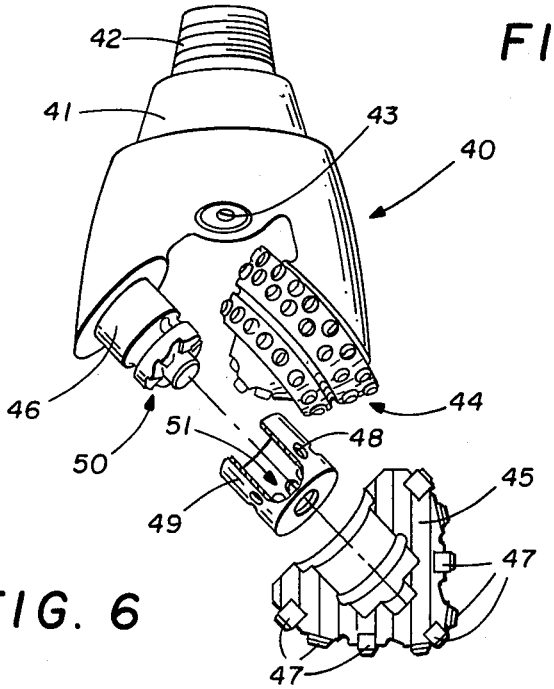
FIG. 6 illustrates another embodiment of the present invention.

Referring now to FIG. 6, rolling cone cutter rotary rock bit 40 constructed in accordance with another embodiment of the present invention is illustrated. The body 41 of the bit 40 includes an upper threaded portion 42 that allows the bit 40 to be connected to the lower end of a rotary drill string. The bit 40 also includes a central passageway. Drilling fluid enters the bit 40 from the drill string immediately above and passes downward through jet nozzles 43 to the bottom of the well bore to flush cuttings and drilling debris from the well bore. The drilling fluid carries the cuttings and drilling debris upward in the annulus between the wall of the borehole and the outside of the bit and drill string.

Individual bearing pins extend from the body 41 of the bit 40. A first cutter 44 is rotatably positioned on the journal portion or bearing pin of a first arm and adapted to disintegrate the earth formations as the bit 40 is rotated. The cutting structure on the surface of cutter 44 contacts and disintegrates the formations in a manner that is well known in the art. A second cutter 45 is rotatably positioned on the journal portion or bearing pin 46 of a second arm and adapted to disintegrate the earth formations as the bit 40 is rotated. The cutting structure 47 on the surface of cutter 45 contacts and disintegrates the formations in a manner that is well known in the art.

The cutter 45 is rotatably positioned on the bearing pin 46 and adapted to disintegrate the earth formations as the bit 40 is rotated. A series of ball bearings insure that rotatable cutter 45 is rotatably locked on bearing pin 46. The rotatable cutter 45 is positioned upon bearing pin 46 and the series of ball bearings are inserted through a bore extending into bearing pin 46. The ball bearings extend through the holes 48 in the canister outer bushing 49. After the ball bearings are in place, a plug is inserted in the bore and welded therein.

In addition to rotational forces, the bit 40 is subjected to a thrust load during the earth boring operation. The weight of the drill string and/or the downward force applied by the rotary drilling equipment apply a substantial thrust load upon the earth boring bit 40. Since the thrust load is applied axially to the bit, a specific load bearing area is produced on the lower side of the bearing pin 46. The canister outer bushing 49 being locked to the bearing pin 46 also has a specific load area on its lower side. The outer bearing surface of the rolling cone cutter 45 rotates against the load area on the outer canister bushing 49. As the bit 40 is rotated and moved through the earth formations, the load bearing area tends to wear. This wear can result in erratic movement of the rolling cone cutter 45 upon the bearing pin 46. Such erratic movement can cause difficulties with the sealing system used in the bit 40. Further, the wear of the load bearing area tends to deteriorate the bearing surface and reduces the lifetime of the bit.

The canister bearing element 49 has directional stops 51 on its inside surface. These directional stops engage directional stops 50 on the bearing pin 46 and prevent rotation of the canister bearing element 49 during normal drilling operations. The rolling cone cutter 45 rotates about the canister bearing element in a first direction during normal drilling operations. The bearing surface in the load area can be renewed by reversing the direction of cone cutter rotation thereby disengaging the canister bearing element 49 and allowing it to rotate in the opposite direction until a new surface is in the load area. The new surface is locked in place by the directional stops 50 and 51. The directional stops 50 and 51 can alternatively be located between the rolling cutter 45 and the canister bearing element 49. This will result in the canister bearing element rotating with the cutter 45 during normal drilling operations. The wear surface will then be between the inside of the canister bearing element and the bearing pin 46.

Figure 7:
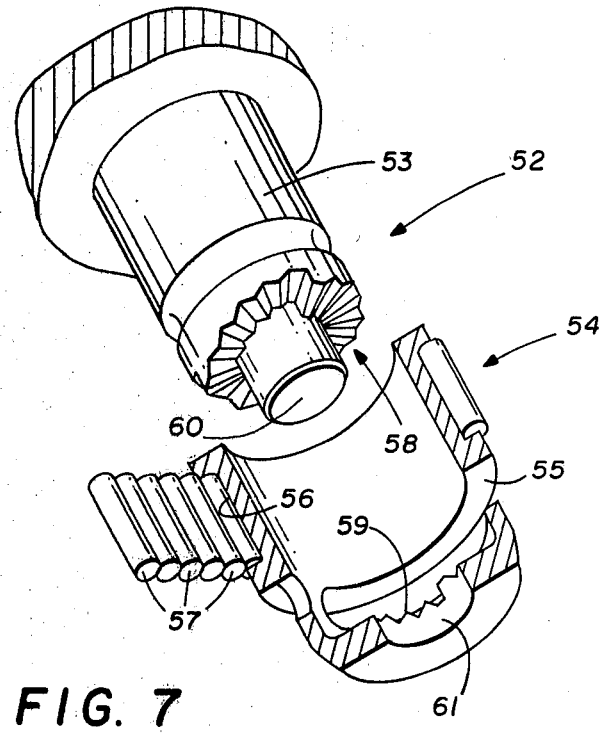
FIG. 7 illustrates yet another embodiment of the present invention.

Referring also now to FIG. 7, a bearing pin and canister bearing element of rolling cone cutter rotary rock bit 52 constructed according to another embodiment of the present invention is illustrated. The bit 52 will be connected to the lower end of a rotary drill string. A bearing pin 53 extends from the body of the bit 52. A cutter is rotatably positioned on the bearing pin 53. A series of ball bearings insure the cutter is rotatably locked on bearing pin 53. The ball bearings extend through a groove 55 in the canister outer bushing 54. The canister outer bushing 54 is positioned between the bearing pin 53 and the rolling cone cutter. The bushing 54 has directional stops 59 on its inside surface. These directional stops engage directional stops 58 on the bearing pin 53, thus preventing rotation of the canister outer bushing 54 during rotation of the cone cutter under normal drilling operations. Reversing cone cutter rotation disengages the canister outer bushing 54, rotating it in the opposite direction until a new bearing surface is in the load bearing area.

The canister bearing element 54 includes a roller bearing raceway 56 and a multiplicity of rollers 57. This provides a roller bearing system between the rolling cone cutter and the bearing pin to promote rotation of the rolling cone cutter. In addition to rotational forces, the bit 52 is subjected to a thrust load during the earth boring operation. The weight of the drill string and/or the downward force applied by the rotary drilling equipment apply a substantial thrust load upon the earth boring bit 52. Since the thrust load is applied axially to the bit, a specific load bearing area is produced on the lower side of the bearing pin 53. The canister outer bushing 54 being locked to the bearing pin 53 also has a specific load area on the lower side of the roller bearing raceway 56. As the bit 52 is rotated and moved through the earth formations, the load bearing areas tend to wear. This wear can result in erratic movement of the rolling cone cutter upon the bearing pin. Such erratic movement can cause difficulties with the sealing system of the bit. Further, the wear of the load bearing area tends to deteriorate the bearing surface and reduces the lifetime of the bit. Renewal of the load surface in the roller bearing raceway extends the lifetime of the bit.

Figure 8:
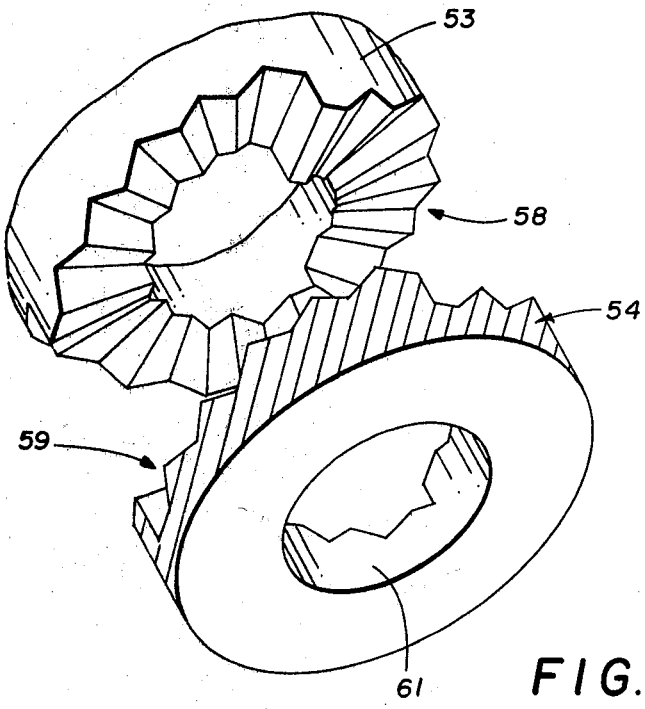
FIG. 8 is an enlarged view of directional stop elements of the embodiment of the present invention illustrated in FIG. 7.

The nose 60 of the bearing pin 53 contacts the thrust button in the rolling cutter through hole 61 in canister bushing 54. This thrust bearing system comprising the nose 60 and the thrust button carry thrust loads applied axially to the bearing pin 53. Wear on the thrust bearing system is detrimental to the bit 52. The stop elements 58 and 59 provide compensation for such wear. As shown in FIG. 8, the stop elements 58 and 59 on the bearing pin 53 and canister bearing element 54 include multiple stop elements on a ramp surface. The ramp surface provides axial movement of the thrust bearing system components to compensate for wear.

The embodiments of the invention in which an exclusive property or privilege is claimed are defined as follows:

1. In an earth boring bit having a bit body with a bearing pin extending from said bit body and a rolling cutter mounted for rotation about said bearing pin, the improvement comprising:

a bearing element located between said bearing pin and said rolling cutter and means for selectively locking said bearing element to one of said bearing pin and rolling cutter for selectively allowing said bearing element to rotate and be locked to one of said bearing pin and rolling cutter.

2. In an earth boring bit having a bit body with a bearing pin extending from said bit body and a rolling cone cutter rotatably mounted upon said bearing pin, the improvement comprising:

a bearing element positioned between said bearing pin and said rolling cone cutter and means for selectively locking said bearing element to said bearing pin and for selectively allowing said bearing element to rotate relative to said bearing pin.

3. An earth boring bit, comprising:

a bit body;

a bearing pin extending from said bit body;

a rolling cutter rotatably mounted on said bearing pin;

an annular bearing member positioned between said bearing pin and said rolling cutter;

directional stop means on one of said bearing pin and said rolling cutter; and directional stop means on said annular bearing member for engaging said stop means on one of said bearing pin and rolling cutter.

4. An earth boring bit, comprising:

a bit body;

a bearing pin extending from said bit body;

a rolling cutter rotatably mounted on said bearing pin;

an annular bearing member positioned between said bearing pin and said rolling cutter;

directional stop means on said bearing pin; and directional stop means on said annular bearing member.

5. An earth boring bit, comprising:

an earth boring bit body;

at least one bearing pin extending from said earth boring bit body, said bearing pin having a radial thrust bearing surface with directional stop means on said radial thrust bearing surface;

a rolling cone cutter mounted over said bearing pin, said rolling cone cutter having a radial thrust bearing surface aligned with said radial thrust bearing surface of said bearing pin; and a canister bearing member rotatably positioned between said bearing pin and said rolling cone cutter, said canister bearing member having a radial thrust bearing surface opposing said radial thrust bearing surface on said bearing pin with directional stop means that engage said directional stop means on said radial thrust bearing surface of said bearing pin.

6. The earth boring bit of claim 5 wherein said directional stop means on said bearing pin and canister bearing member provide axial adjustment.

7. A journal bearing rotary rock bit, comprising:

a bit body;

a bearing pin extending from said bit body;

a rolling cone cutter mounted over said bearing pin;

a canister bearing element between said bearing pin and said rolling cone cutter;

matched radial surfaces on said bearing pin and canister bearing element known as thrust bearing surfaces, one of said radial surfaces being the radial surface of the bearing pin known as the bearing pin inner flange and the matching radial surface in the canister bearing element being known as the canister inner flange;

directional stop means in the bearing pin inner flange and the canister inner flange that engage to selectively allow relative rotation in one direction but prevent relative rotation in the opposite direction.

* * * * *